US009179768B2

(12) United States Patent
Stubbs et al.

(10) Patent No.: US 9,179,768 B2
(45) Date of Patent: Nov. 10, 2015

(54) TABLE FURNITURE AND ASSEMBLY KIT FOR GENERATING AN ARRAY OF ITEMS OF FURNITURE

(71) Applicant: VS VEREINIGTE SPEZIALMOEBELFABRIKEN GMBH & CO. KG, Tauberbischofsheim (DE)

(72) Inventors: David Stubbs, Bogart, GA (US); Jonathan Pidwell, Tauberbischofsheim (DE); Gerhard Lippert, Koenigheim (DE); Reinhard Weber, Minden (DE)

(73) Assignee: VS Vereinigte SpezialmoebelfabrikenGmbH & Co. KG, Tauberbischofsheim (DE)

( * ) Notice: Subject to any disclaimer, the term of this patent is extended or adjusted under 35 U.S.C. 154(b) by 0 days.

(21) Appl. No.: 14/184,908

(22) Filed: Feb. 20, 2014

(65) Prior Publication Data

US 2015/0028633 A1 Jan. 29, 2015

Related U.S. Application Data

(60) Provisional application No. 61/858,378, filed on Jul. 25, 2013.

(51) Int. Cl.

| | |
|---|---|
| ***A47B 57/00*** | (2006.01) |
| ***A47B 13/10*** | (2006.01) |
| ***A47B 87/00*** | (2006.01) |

(Continued)

(52) U.S. Cl.

CPC . *A47B 13/10* (2013.01); *A47B 7/00* (2013.01); *A47B 9/00* (2013.01); *A47B 13/02* (2013.01); *A47B 83/02* (2013.01); *A47B 83/04* (2013.01); *A47B 87/002* (2013.01)

(58) Field of Classification Search

CPC ..... A47B 23/02; A47B 83/02; A47B 87/002; A47B 87/005; A47B 87/007; A47B 87/004; A47B 3/10; A47B 3/088; A47B 87/0041

USPC ..... 108/64, 65, 66; 297/141, 135, 136

See application file for complete search history.

(56) References Cited

U.S. PATENT DOCUMENTS

| | | | | |
|---|---|---|---|---|
| 2,709,119 | A * | 5/1955 | Chapman et al. | 108/91 |
| 2,871,073 | A * | 1/1959 | Swanson | 108/64 |

(Continued)

FOREIGN PATENT DOCUMENTS

| | | | |
|---|---|---|---|
| DE | 9315133 | U1 | 12/1993 |
| DE | 2020050103901 | U1 | 7/2006 |

(Continued)

*Primary Examiner* — Jose V Chen

(74) *Attorney, Agent, or Firm* — Laurence A. Greenberg; Werner H. Stemer; Ralph E. Locher

(57) ABSTRACT

An item of table furniture has a table top and a table frame supporting the table top. The table top, in plan view, is formed with first pair of opposite edges and a second pair of opposite edges. One edge of the first pair of edges is convex and the other edge of the first pair of edges is concave. The convex curvature and the concave curvature of the first pair of edges has a predetermined first radius of curvature of substantially equal size. One edge of the second pair of edges is longer than the other edge of the second pair of edges. Such a table can be arranged together with items of table furniture of the same kind and also with other items of furniture to an array in many ways.

19 Claims, 17 Drawing Sheets

(51) Int. Cl.

| | |
|---|---|
| ***A47B 7/00*** | (2006.01) |
| ***A47B 9/00*** | (2006.01) |
| ***A47B 13/02*** | (2006.01) |
| ***A47B 83/02*** | (2006.01) |
| ***A47B 83/04*** | (2006.01) |

(56) References Cited

U.S. PATENT DOCUMENTS

| | | | | | |
|---|---|---|---|---|---|
| 3,053,598 | A | * | 9/1962 | Cheslow | 108/64 |
| 3,741,852 | A | * | 6/1973 | Keener | 108/64 |
| 4,878,439 | A | * | 11/1989 | Samson | 108/64 |
| 5,016,405 | A | * | 5/1991 | Lee | 108/64 |
| 5,277,130 | A | * | 1/1994 | Caporrella | 108/64 |
| D352,853 | S | * | 11/1994 | Hosoe | D6/482 |
| 5,438,937 | A | * | 8/1995 | Ball et al. | 108/64 |
| 5,655,822 | A | * | 8/1997 | Roberts et al. | 108/64 |
| D383,924 | S | * | 9/1997 | Dormon et al. | D6/482 |
| D390,381 | S | * | 2/1998 | Dormon et al. | D6/482 |
| 6,170,410 | B1 | * | 1/2001 | Gioacchini et al. | 108/64 |
| 6,363,866 | B1 | * | 4/2002 | Schwartz | 108/64 |
| 6,397,762 | B1 | * | 6/2002 | Goldberg et al. | 108/64 |
| 6,739,670 | B2 | * | 5/2004 | Johnson | 297/423.41 |
| 7,827,920 | B2 | * | 11/2010 | Beck et al. | 108/64 |
| D703,984 | S | * | 5/2014 | Nasseri et al. | D6/707.22 |
| 8,776,699 | B2 | * | 7/2014 | Nasseri et al. | 108/64 |
| 2005/0274297 | A1 | * | 12/2005 | Montague et al. | 108/64 |
| 2006/0254479 | A1 | * | 11/2006 | Luchetti et al. | 108/64 |
| 2010/0277043 | A1 | * | 11/2010 | Bloch et al. | 108/50.11 |

FOREIGN PATENT DOCUMENTS

| | | | |
|---|---|---|---|
| DE | 202008012782 | U1 | 12/2008 |
| EP | 0648450 | A1 | 4/1995 |
| GB | 2478905 | A1 | 9/2011 |

* cited by examiner

FIG. 9B
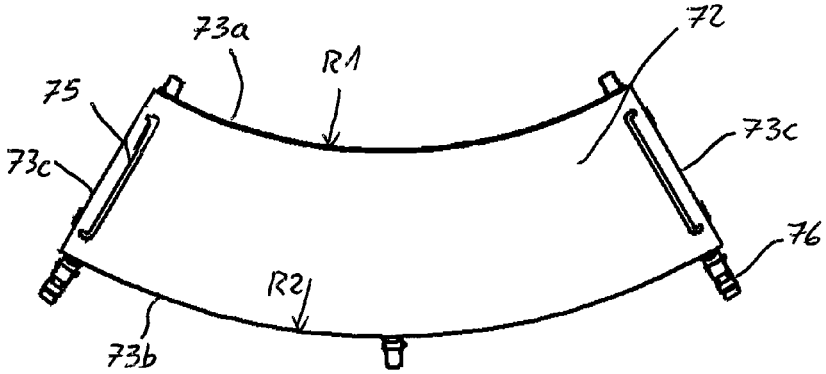
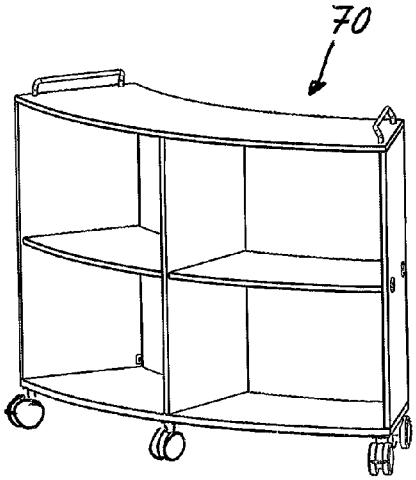
FIG. 9A
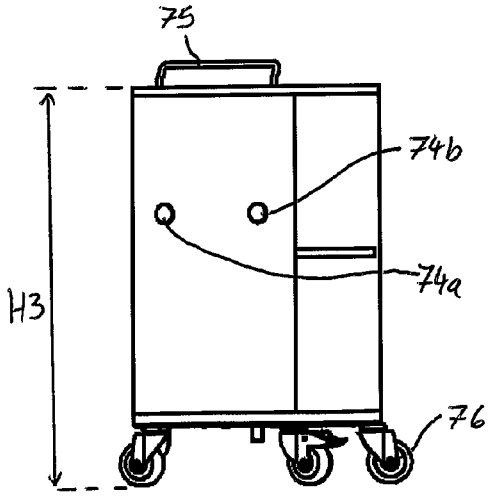
FIG. 9C

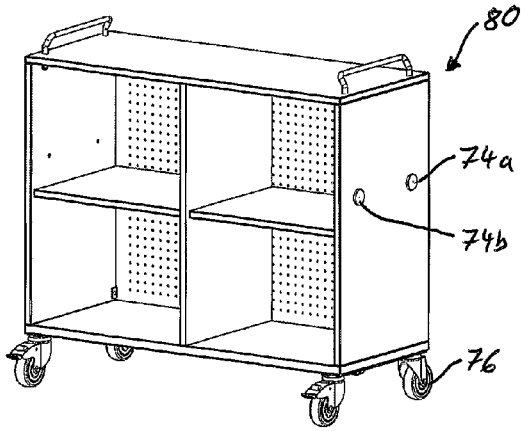
FIG. 10
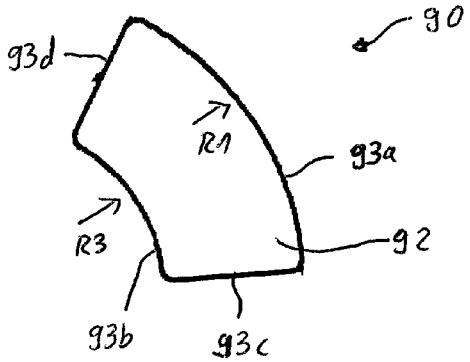
FIG. 11A
FIG. 11B
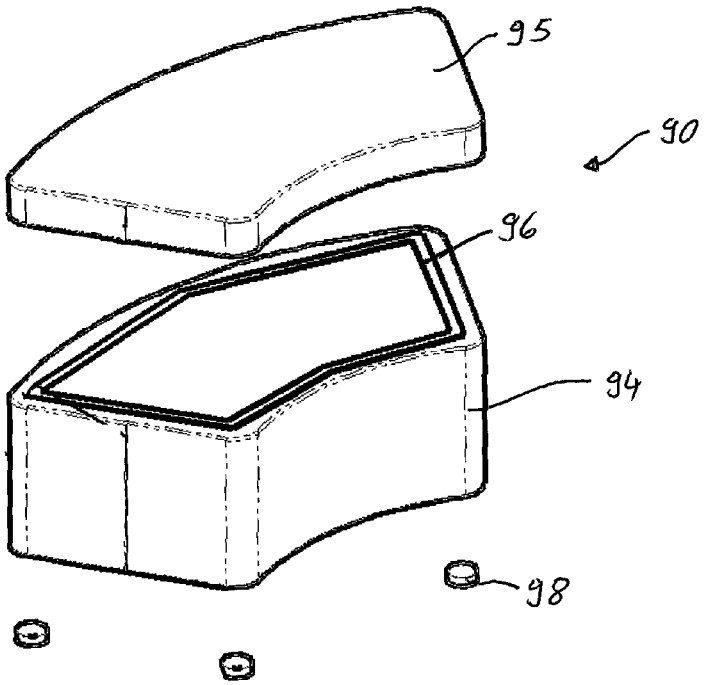

TABLE FURNITURE AND ASSEMBLY KIT FOR GENERATING AN ARRAY OF ITEMS OF FURNITURE

CROSS-REFERENCE TO RELATED APPLICATION

This application claims the benefit, under 35 U.S.C. §119 (e), of provisional patent application No. 61/858,378, filed Jul. 25, 2013; the prior application is herewith incorporated by reference in its entirety.

BACKGROUND OF THE INVENTION

Field of the Invention

The invention relates to an item of table furniture and an assembly kit for generating an array of items of furniture.

Table furniture is available in various configurations in different designs and in different sizes. In a plan view, table tops of items of table furniture for example have a first pair of opposite edges and a second pair of opposite edges each connecting the first pair of edges to one another. On the market, for example, there is also table furniture comprising table tops, wherein at least part of the edges has a concave or convex curvature. Depending on the design especially of the table tops, it is sometimes difficult, if not impossible, to arrange such items of table furniture together with the same items of table furniture or different items of table furniture to an array of items of furniture, in an elegant and practical way.

SUMMARY OF THE INVENTION

It is accordingly an object of the invention to provide an item of table furniture which overcomes a variety of disadvantages of the heretofore-known devices and methods of this general type and which provides for a product that can be arranged together with equal items of table furniture to assemblies of tables, as well as an assembly kit for generating an array of items of furniture to provide different workplaces or workplace arrangements in an easy way.

With the foregoing and other objects in view there is provided, in accordance with the invention, an item of table furniture, comprising:

a table top and a table frame supporting said table top, wherein said table top, in plan view, has a first pair of mutually opposite edges and a second pair of mutually opposite edges each connecting said first pair of edges to one another;

said first pair of edges including a convex edge with a convex curvature and a concave edge with a concave curvature;

said convex curvature of said convex edge and said concave curvature of said concave edge of said first pair of edges each having a pre-determined first radius of curvature of substantially equal size; and said second pair of edges including a longer edge and a shorter edge, said longer edge of said second pair of edges having a greater length than said shorter edge of said second pair of edges.

With the above and other objects in view there is also provided, in accordance with the invention, an assembly kit for generating an array of items of furniture, comprising:

at least one first item of furniture which, in plan view, is formed with an edge having a convex curvature with a predetermined first radius of curvature; and at least one second item of furniture which, in plan view, is formed with an edge having a concave curvature with said predetermined first radius of curvature.

The item of table furniture of the invention comprises a table top and a table frame supporting the table top, wherein the table top, in plan view, comprises of a first pair of opposite edges and a second pair of opposite edges connecting the first pair of edges to one another. In this case, the one edge of the first pair of edges has a convex curvature, and the other edge of the first pair of edges has a concave curvature. The convex curvature of the one edge and the concave curvature of the other edge of the first pair of edges have a predetermined first radius of curvature of substantially equal size, and the one edge of the second pair of edges has a length being larger than that of the other edge of the second pair of edges.

An item of table furniture comprising a table top designed in this way can be arranged together in many different ways with the same or equal items of table furniture and/or other items of furniture to easily generate different workplaces/workplace arrangements for one or more persons. Due to the same radius of curvature the convex and concave curved edges of the table top of these items of table furniture can be put together without any spaces in between, so that a substantially closed working surface can be effected extending over the table tops of a plurality of items of table furniture. In particular, two such items of table furniture can be put adjacent to each other at their first pair of edges since the two opposite edges of the first pair of edges are configured as convex/concave curved pair of edges having the same radius of curvature.

In addition, the item of table furniture of the invention offers an elegant design, due to the asymmetric design of its table top, which differs from conventional items of table furniture often having symmetrically designed table tops.

The item of table furniture of the invention can be used in a particularly advantageous manner in schools and other educational institutions, seminar rooms, meeting rooms, open space offices, etc. Variable and practical arrangements of items of (table) furniture for one or more persons may be generated there.

To construct a table top of such an item of table furniture of the invention the center points of the radii of curvature of the one and the other edges of the first pair of edges do not coincide, and the radial center axes of their curvatures also do not coincide, resulting in edges of the second edge pair being of different lengths.

The table top of the inventive item of table furniture is basically made of any material or any combination of materials. Preferably, plastic, wood, metal and glass materials can be used for the table top. The table frame of the inventive item of table furniture is also basically made of any material or any combination of materials. Preferably, plastic, wood and metallic materials may be used for the table frame.

In this context, the terms “convex curvature” or “convex” and “convexity” designate an outward curvature of a respective edge of the table top, in plan view of the table plate. In this context, the terms “concave curvature” or “concavity” designate an inward curvature of a respective edge of the table top, in plan view of the table top. Preferably, the edges of the first pair of edges of the table top each have exactly one convex or concave curvature, respectively. Preferably, these curvatures each extend over substantially the entire length of the edges. Preferably, the convex/concave curvature of an edge of the table top has a substantially constant radius of curvature along the entire curvature. In the case of optionally rounded corners between the edges of the first and second pair of edges, the convex curvature and the concave curvature each merge preferably substantially tangentially, i.e. without any edge (in mathematic sense without any discontinuity) into the rounding of the respective corner. Preferably, the first predetermined radius of curvature is in the range from about 80 cm to about 150 cm, more preferably it is about 110 cm.

In a preferred configuration of the invention, the one edge of the second pair of edges of the table top has a convex curvature having the first radius of curvature, a concave curvature having the first radius of curvature or a substantially linear shape.

In a preferred configuration of the invention, the other edge of the second pair of edges of the table top has a convex curvature having the first radius of curvature, a concave curvature having the first radius of curvature or a substantially linear shape.

Since all (convex or concave) curvatures of the edges of the table top have the same first radius of curvature, these table tops can be put together in a variable manner and preferably substantially without any gaps in between. Similarly, these table tops can be put together with other items of (table) furniture in a variable manner and preferably substantially without any gaps in between, if they also have an edge or a side comprising a convex or concave curvature having the first radius of curvature.

In a preferred embodiment of the item of table furniture, the one edge of the second pair of edges of the table top has a convex curvature, and the other edge of the second pair of edges of the table top has also a convex curvature or a linear shape. In an alternative preferred embodiment of the item of table furniture, the one edge of the second pair of edges of the table top has a concave curvature, and the other edge of the second pair of edges of the table top has also a concave curvature or a linear shape.

In a preferred configuration of the invention, the table top in plan view spans an annulus segment having an opening angle, which is selected from 30°, 36°, 45°, 60°, 72° and 90°. Inventive items of table furniture having these angular dimensions can be particularly easily arranged together in an arc or circle shape.

In a preferred configuration of the invention, the table frame has a plurality of table legs, at least one table leg of them being arranged outside the table top, in plan view. Preferably, the table frame has a total of four table legs in the corner regions of the table top, two or three of them being arranged outside the table top (in plan view). Due to the table legs arranged outside the table top in this sense, the items of table furniture can be stacked on each other in a space saving manner, for storage or transport. When stacking multiple items of table furniture on top of each other, in particular, the table top of a lower item of table furniture can be placed between the table legs of an upper item of table furniture so that the items of table furniture can be nested within each other.

In a further preferred configuration of the invention the table frame comprises a plurality of table legs, the table legs of which being positioned in the region of the one edge or the other edge of one of the pairs of edges of the table top each being equipped with a caster, and the table top comprises at least one auxiliary device for gripping the table top in the region of the other edge or the one edge of the one pair of edges. With this configuration, the item of table furniture can be gripped in the region of one edge of the table top at the auxiliary device, and lifted slightly so as to be then moved easily by means of the casters in the region of the opposite edge. By this measure, a change of an array of a plurality of such items of table furniture is possible in a simple and convenient manner.

In another configuration of the invention, optionally all table legs of the table frame may be equipped with casters to allow for easy and comfortable moving the item of table furniture.

In a further preferred configuration of the invention, the table frame is configured as a height-adjustable table frame.

In yet another configuration of the invention, the table top of the item of table furniture is, for example at its bottom side and/or its upper side, equipped with at least one electrical connection device for an electronic apparatus. In this context, the electrical connection devices include especially power connectors and power strips for power supply, a telephone connection, a data connection, a network connection, and the like.

The above object is also solved by an assembly kit for generating an array of items of furniture, comprising at least one first item of furniture having, in plan view, an edge having a convex curvature having a predetermined first radius of curvature, and at least one second item of furniture having, in plan view, an edge having a concave curvature having the predetermined first radius of curvature.

With this assembly kit, arrays of items of furniture can be arranged or put together easily and also variably in order to create, for example, different workplaces/workplace arrangements for one or more persons. Due to the radii of curvature selected equally, the convex and concave curved edges of the items of furniture may be arranged or put together substantially without any spaces in between, so that a substantially closed workspace can arise within the array of several items of furniture.

In a preferred configuration of the invention, the first and second items of furniture of this assembly kit each are an above-described item of table furniture of the invention. Thus, with this assembly kit, the same advantages as with the above-described item of table furniture according to the invention can be achieved. In particular, the same or equal items of table furniture of the assembly kit can be arranged or put together in various ways to create different workplaces/workplace arrangements for one or more persons.

In a preferred configuration of the invention, the first items of furniture of the assembly kit are a first item of table furniture of the invention in which the one edge of the second pair of edges of the table tope has a convex curvature having the first radius of curvature, and the second items of furniture are a second item of table furniture of the invention in which the one edge of the second pair of edges of the table top has a concave curvature having the first radius of curvature.

With this assembly kit, the same advantages as with the above-described item of table furniture according to the invention can be achieved. In particular, the first and second items of table furniture of the assembly kit can be arranged or put together in various ways to create different workplaces/workplace arrangements for one or more persons. In particular, first and second items of table furniture can be arranged or put together such that a convexly curved edge of the table top of one item of table furniture engages a concavely curved edge of the table top of another item of table furniture.

For further features, advantages, definitions of terms and preferred configurations, reference is made to the above explanations in connection with the item of table furniture of the invention.

In a preferred configuration of the invention, the lengths of the one edges of the first pairs of edges of the table tops of the first item of table furniture and of the second item of table furniture and/or the lengths of the other edges of the first pairs of edges of the table tops of the first item of table furniture and of the second item of table furniture and/or the lengths of the one edges of the second pairs of edges of the table tops of the first item of table furniture and of the second item of table furniture and/or the lengths of the other edges of the second pairs of edges of the table tops of the first item of table furniture and of the second item of table furniture are substantially the same size. Preferably, the lengths of all the edges of the table tops of the first and second items of table furniture each are the same size so that the table tops of the first and second items of table furniture with respect to the positions of their corners between the edges are substantially the same size.

In a preferred configuration of the invention, the assembly kit (alternatively or additionally) comprises at least one third item of table furniture comprising a table top and a table frame supporting the table top, wherein the table top, in plan view, has a first pair of opposite edges and a second pair of opposite edges each connecting the first pair of edges to one another, wherein the one edge of the first pair of edges of the table top of the third item of table furniture has a convex curvature having the first radius of curvature, and wherein a length of the one edge of the first pair of edges of the table top of the third item of table furniture is at least as large as twice a length of the other edge of the second pair of edges of the table top of the first item of table furniture or the second item of table furniture. Preferably, the length of the one edge of the first pair of edges of the table top of the third item of table furniture is at least as large as twice the length of the one edge of the second pair of edges of the table top of the first item of table furniture or the second item of table furniture.

The table top of the third item of table furniture is (significantly) larger in size than the table tops of the first and second items of table furniture so that the third item of table furniture can preferably be used as a master table, staff table, discussion leader table, etc. in an array of items of table furniture. Due to the consistent first radius of curvature at the curved edges of the table tops of the first, second and third items of table furniture, they can be arranged or put together variably to create different workplaces/workplace arrangements.

The table top of this third item of table furniture preferably comprises at least one further feature selected from the other edge of the first pair of edges having a substantially linear shape, the one edge of the second pair of edges having a convex curvature having the first radius of curvature, a concave curvature having the first radius of curvature or a substantially linear shape, and the other edge of the second pair of edges having a convex curvature having the first radius of curvature, a concave curvature having the first radius of curvature or a substantially linear shape.

In a preferred configuration of the invention, the table legs of the table frame of the third item of table furniture are equipped with casters to allow for easy and comfortable moving the third item of table furniture.

In another preferred configuration of the invention, the table frame of the third item of table furniture is configured as a height-adjustable table frame.

In yet another configuration of the invention, the table top of the third item of table furniture is, for example on its underside and/or its upper side, equipped with at least one electrical connection device for an electronic apparatus. In this context, the electrical connection devices include in particular power connectors and power strips for power supply, a telephone connection, a data connection, a network connection, and the like.

In a preferred configuration of the invention, the assembly kit (alternatively or additionally) comprises at least one fourth item of table furniture comprising a table top and a table frame supporting the table top, wherein the table top, in plan view, comprises a first pair of opposite edges and a second pair of opposite edges each connecting the first pair of edges to one another, wherein the edges of the first pair of edges of the table top of the fourth item of table furniture each have a convexity having the first radius of curvature and a concavity having the first radius of curvature, wherein these convexities are positioned facing each other and these concavities are positioned facing each other.

The table top of the fourth item of table furniture is larger in size than the table tops of the first and second items of table furniture and has a special "double wave form". Due to the consisting first radius of curvature at the curved edges of the table tops of the first, second, third and fourth items of table furniture they can be arranged or put together variably to different workplaces/workplace arrangements.

The table top of this fourth item of table furniture preferably comprises at least one further feature selected from a length of the edges of the first pair of edges being substantially twice as large as a length of the edges of the second pair of edges, the one edge of the second pair of edges having a convex curvature having the first radius of curvature, a concave curvature having the first radius of curvature or a substantially linear shape, the other edge of the second pair of edges having a convex curvature having the first radius of curvature, a concave curvature having the first radius of curvature or a substantially linear shape, and a length of the edges of the second pair of edges being substantially equal to a length of the one edge or the other edge of the second pair of edges of the table top of the first or second items of table furniture.

In a preferred configuration of the invention, the table legs of the table frame of the fourth item of table furniture are equipped with casters to allow for easy and comfortable moving the fourth item of table furniture.

In another preferred configuration of the invention, the table frame of the fourth item of table furniture is configured as a height-adjustable table frame.

In yet another configuration of the invention, the table top of the fourth item of table furniture is, for example on its underside and/or its upper side, equipped with at least one electrical connection device for an electronic apparatus. In this context, the electrical connection devices include in particular power connectors and power strips for a power supply, a telephone connection, a data connection, a network connection, and the like.

In a preferred configuration of the invention, the table frames of the items of table furniture, first items of table furniture, second items of table furniture, third items of table furniture and fourth items of table furniture, depending on the assembly kit, all have a substantially identical predetermined height.

In a preferred configuration of the invention, the assembly kit (alternatively or additionally) comprises at least one item of shelf furniture comprising a body which, in plan view, has a first pair of opposite sides and a second pair of opposite sides each connecting the first pair of sides to one another, wherein the one side of the first pair of sides has a concave curvature having the first radius of curvature.

Due to the consistent first radius of curvature at the curved edges of the items of table furniture and the curved sides of the items of shelf furniture, they can be arranged or put together variably to create different workplaces/workplace arrangements.

The item of shelf furniture comprises at least one further feature selected from the one side of the first pair of sides of the body having a substantially closed design; the other side of the first pair of sides of the body having a convex curvature having a second radius of curvature being larger than the first radius of curvature; the sides of the second pair of sides of the body having a substantially linear shape; comprising at least one preferably magnetic coupling device at the sides of the second pair of sides of the body; the body being equipped with casters; comprising grip elements on the body; having an essentially radial extension of the second pair of sides of the body, relative to the curvature of the one side of the first pair of sides of the body; comprising centers of the curvatures of the one side and the other side of the first pair of sides of the body on a common center axis, relative to the curvatures; comprising the same center of the curvatures of the one side and the other side of the first pair of sides of the body; and a height of the body being larger than or substantially equal to the height of the item of table furniture of the assembly kit.

In another configuration of the invention, the assembly kit further comprises at least one further item of shelf furniture comprising a body which has, in plan view, a first pair of opposite sides and a second pair of opposite sides each connecting the first pair of sides to one another, wherein the sides of the body all have a substantially linear shape. In other words, the further item of shelf furniture has, in plan view, a body having a substantially rectangular configuration.

In a configuration of the invention, the assembly kit (alternatively or additionally) comprises at least one item of seating furniture comprising a body which has, in plan view, a first pair of opposite sides and a second pair of opposite sides each connecting the first pair of sides to one another, wherein the one side of the first pair of sides has a convex curvature having the first radius of curvature.

Due to the consistent first radius of curvature at the curved edges of the items of table furniture and the curved sides of the items of shelf furniture and the items of seating furniture, they can be arranged or put together variably to create different workplaces/workplace arrangements.

In addition, the item of seating furniture comprises at least one further feature selected from the other side of the first pair of sides of the body having a concave curvature having a third radius of curvature being smaller than the first radius of curvature; the sides of the second pair of sides of the body having a substantially linear shape; the body being configured as an upholstered item of seating furniture; the body being configured as an assembly kit made of at least two components; the heights of the body being variably selectable due to a construction in kit form; the second pair of sides of the body having a substantially radial extension, relative to the curvature of the one side of the first pair of sides; comprising centers of the curvatures of the one side and the other side of the first pair of sides of the body on a common center axis, relative to the curvatures; comprising a common center of the curvatures of the one side and the other side of the first pair of sides of the body; and a height of body being smaller than or substantially equal to the height of the item of table furniture of the assembly kit.

In another configuration of the invention, the assembly kit further comprises at least one further item of seating furniture comprising a body which has, in plan view, a first pair of opposite sides and a second pair of opposite sides each connecting the first pair of sides to one another, wherein the sides of the body all have a substantially linear shape. In other words, the further item of seating furniture has, in plan view, a body having a substantially rectangular configuration.

In yet another configuration of the invention, the assembly kit (alternatively or additionally) comprises at least one fifth item of table furniture comprising a table top and a table frame supporting the table top, wherein the table top comprises, in a plan view, a first pair of opposite edges and a second pair of opposite edges each connecting the first pair of edges, wherein at least one edge of the first pair of edges has a convex curvature having the first radius of curvature, and wherein the table frame has a height-adjustable table column.

Preferably, this fifth item of table furniture has at least one further feature selected from having a convex curvature having the first radius of curvature at all edges of the first and the second pair of edges of the table top; the table frame being equipped with casters; comprising a console arranged at the underside of the table top; comprising at least one electrical connecting device for an electronic apparatus being arranged at the underside and/or the top side of the table top, and the like.

The above-mentioned preferred configurations of the invention can be simple or multiple combined with one another in any desired manner.

Other features which are considered as characteristic for the invention are set forth in the appended claims.

Although the invention is illustrated and described herein as embodied in item of table furniture, assembly kit for generating an of items of furniture array it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 9A is a perspective view of an item of shelf furniture according to an embodiment of the invention;

FIG. 9B is a plan view of the item of shelf furniture of FIG. 9A according to an embodiment of the invention;

FIG. 9C is a side view of the item of shelf furniture of FIG. 9A according to an embodiment of the invention;

FIG. 10 is a perspective view of a further item of shelf furniture according to an embodiment of the invention;

FIG. 11A is a plan view of an item of seating furniture according to an embodiment of the invention;

FIG. 11B is an exploded perspective view of the item of seating furniture of FIG. 11A according to an embodiment of the invention.

DETAILED DESCRIPTION OF THE INVENTION

Figure 1:
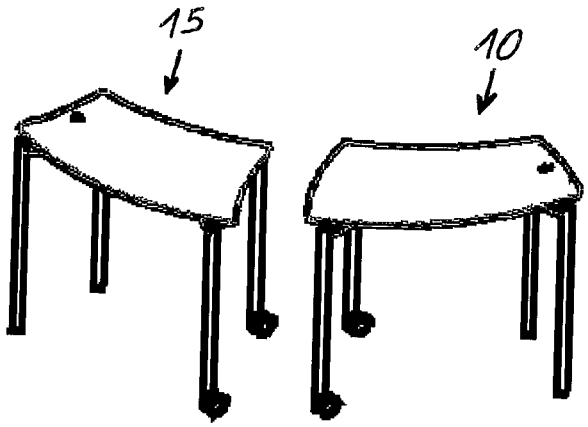
FIG. 1 is a perspective view of a first item of table furniture and a second item of table furniture according to an embodiment of the invention.

Referring now to the figures of the drawing in detail and first, particularly, to FIG. 1 and FIGS. 2A to 2C thereof, there is shown a first item of furniture in the form of a table 10 and a second item of table furniture 15. The first and second items of table furniture 10, 15 are for example parts of an assembly kit for generating an array of items of furniture.

Figure 2A:
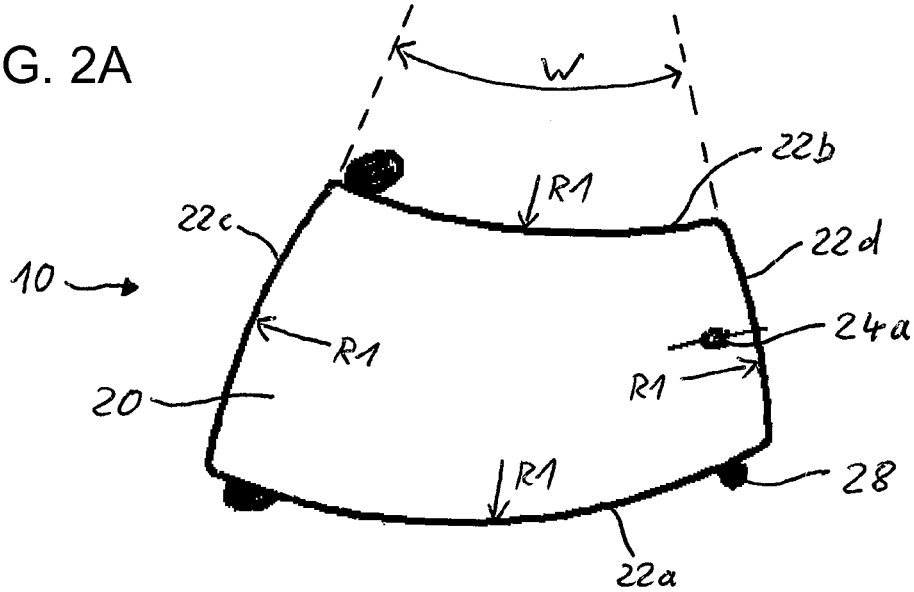
FIG. 2A is a plan view of the first item of table furniture of FIG. 1 according to an embodiment of the invention.
Figure 2B:
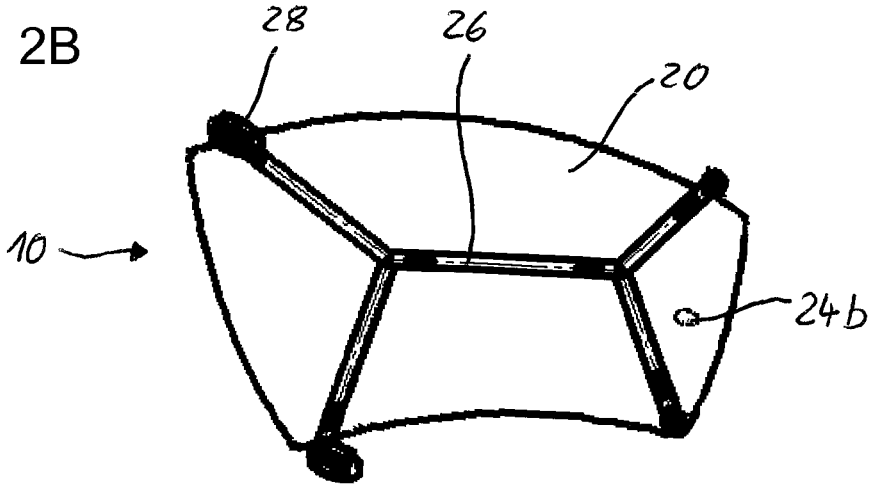
FIG. 2B is a bottom view of the first item of table furniture of FIG. 1 according to an embodiment of the invention.
Figure 2C:
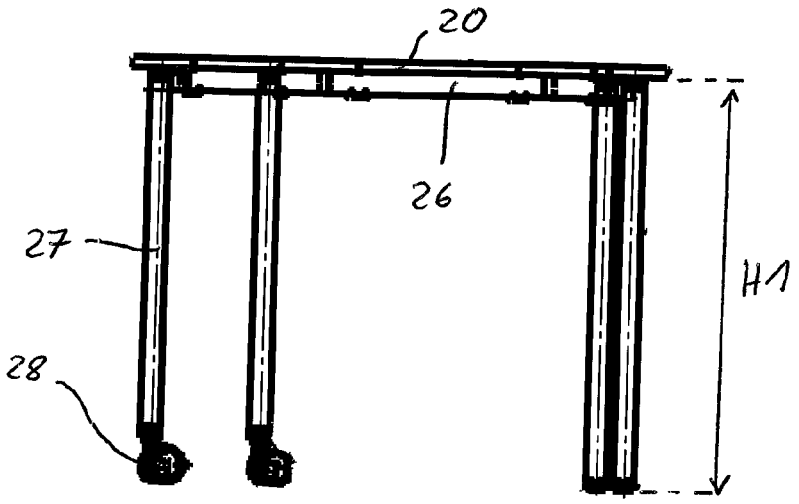
FIG. 2C is a side view of the first item of table furniture of FIG. 1 according to an embodiment of the invention.

FIGS. 2A-2C each show only the first item of table furniture. The second item of table furniture is constructed similarly and is not shown separately for this reason.

The first item of table furniture 10 comprises a table top 20 (for example made of wood and/or plastic). In plan view (see FIG. 2A), this table top 20 comprises a first pair of opposite edges 22*a*, 22*b* (bottom, top in FIG. 2A), and a second pair of opposite edges 22*c*, 22*d* (left, right in FIG. 2A) each connecting the first pair of edges 22*a*, 22*b* to on another. As shown in FIG. 2A, the one edge 22*a* of the first pair of edges has a convex, i.e. outwardly curved curvature having a predetermined first radius of curvature R1, and the other edge 22*b* of the first pair of edges has a concave, i.e. inwardly curved curvature having the same predetermined radius of curvature R1.

The (fictitious) constructing centers of the two curvatures of the edges 22*a*, 22*b* of the first pair of edges are not coincident, and the (fictitious) central axes of the two curvatures of the edges 22*a*, 22*b* of the first pair of edges also do not coincide, so that as a result, the one edge 22*c* (on the left side in FIG. 2A) of the second pair of edges has a length being larger than that of the other edge 22*d* (on the right side in FIG. 2A) of the second pair of edges. This results in an overall asymmetric design of the table top 20. In addition to the functional advantages, also an elegant design of the item of table furniture is achieved.

As shown in FIG. 2A, the edges 22*a*, 22*b* each comprise exactly one curvature (convexity or concavity), which extends substantially over the entire length of the respective edge. In addition, these curvatures merge preferably tangentially, i.e. fluently into the rounded corners of the table top 20.

In a preferred embodiment, the first radius of curvature R1 is about 110 cm, the length of the one edge 22*a* of the first pair of edges is about 97 cm, the length of the other edge 22*b* of the first pair of edges is about 67 cm, the length of the one edge 22*c* of the second pair of edges is about 54 cm, the length of the other edge 22*d* of the second pair of edges is about 39 cm, and an opening angle W is about 36°, without the invention being restricted to these dimensions.

As shown in FIGS. 2B and 2C, the first item of table furniture 10 further comprises a table frame for supporting the table top 20. This table frame comprises, in particular, a frame 26, at/on which the table top 20 is mounted, and (here four) table legs 27 at the corner regions of the table top 20. A part of the table legs 27 (or alternatively all table legs) is equipped with a caster 28, respectively.

In this embodiment, a part of the legs 27 is located outside the table top 20 (see plan view of FIG. 2A), in this case a total of three of the four table legs. By this measure, it is possible to stably stack several of these items of table furniture 10 on top of each other. The table legs 27 located outside of an upper item of table furniture 10 encompass the table top 20 of a lower item of table furniture 10, and the table tops 20 of the items of table furniture are somewhat offset to each other in a direction transverse to the stacking direction.

Moreover, in this embodiment, only the two table legs 27 positioned in the region of the one edge 22*c* of the second pair of edges of the table top 20 are equipped with casters 28. In the region of the other edge 22*d* of the second pair of edges, a first auxiliary device 24*a* is provided on the upper side of the table top 20 (see FIG. 2A), and a second auxiliary device 24*b* is provided on the underside of the table top 20 (see FIG. 2B). The auxiliary devices 24*a*, 24*b* are for example colored and/or haptic markings. A user grip the table top 20 at the auxiliary devices 24*a*, 24*b*, and thus raise the item of table furniture 20 at the other edge 22*d* of the second pair of edges and simply move it on the casters 28 at the table legs 27 at the opposite one edge 22*c* of the second pair of edges. The table legs 27 having casters 28 are in total as high as the table legs 27 alone having no casters 28.

At the illustrated first item of table furniture 10, also the edges 22*c*, 22*d* of the second pair of edges of the table top 20 each have a convex curvature having the same first radius of curvature R1. The second item of table furniture 15 differs from that first item of table furniture 10 in that the two edges 22*c*, 22*d* of the second pair of edges of the table plate 20 each have a concave curvature of the same first radius of curvature R1.

Figure 3:
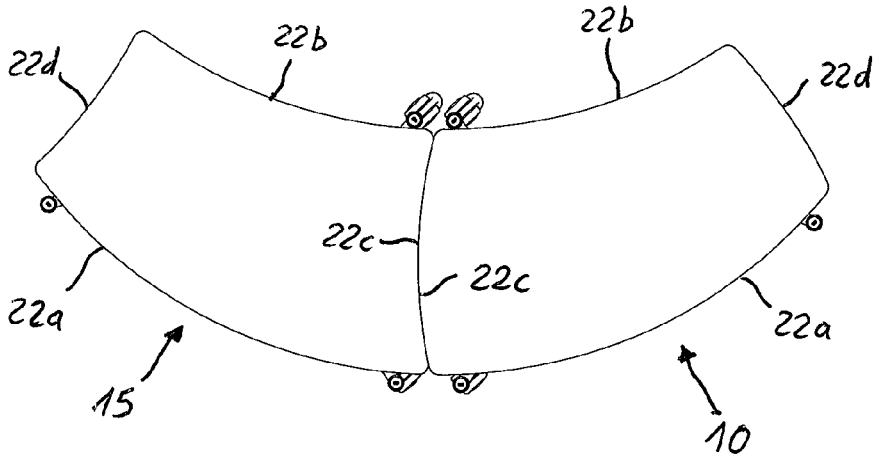
FIG. 3 is a schematic diagram of a first exemplary arrangement of one first and one second item of table furniture of the invention.

In addition, the one convex curved edges 22*a* of the first pair of edges, the other concave curved edges 22*b* of the first pair of edges, the one convex or concave curved edges 22*c* of the second pair of edges being longer, and the other convex or concave curved edges 22*d* of the second pair of edges being shorter each have the same length in the first and second items of table furniture 10, 15. Thus, as exemplified in FIG. 3, a first item of table furniture 10 and a second item of table furniture 15 can advantageously be put together in a substantially gap-free manner.

Figure 6:
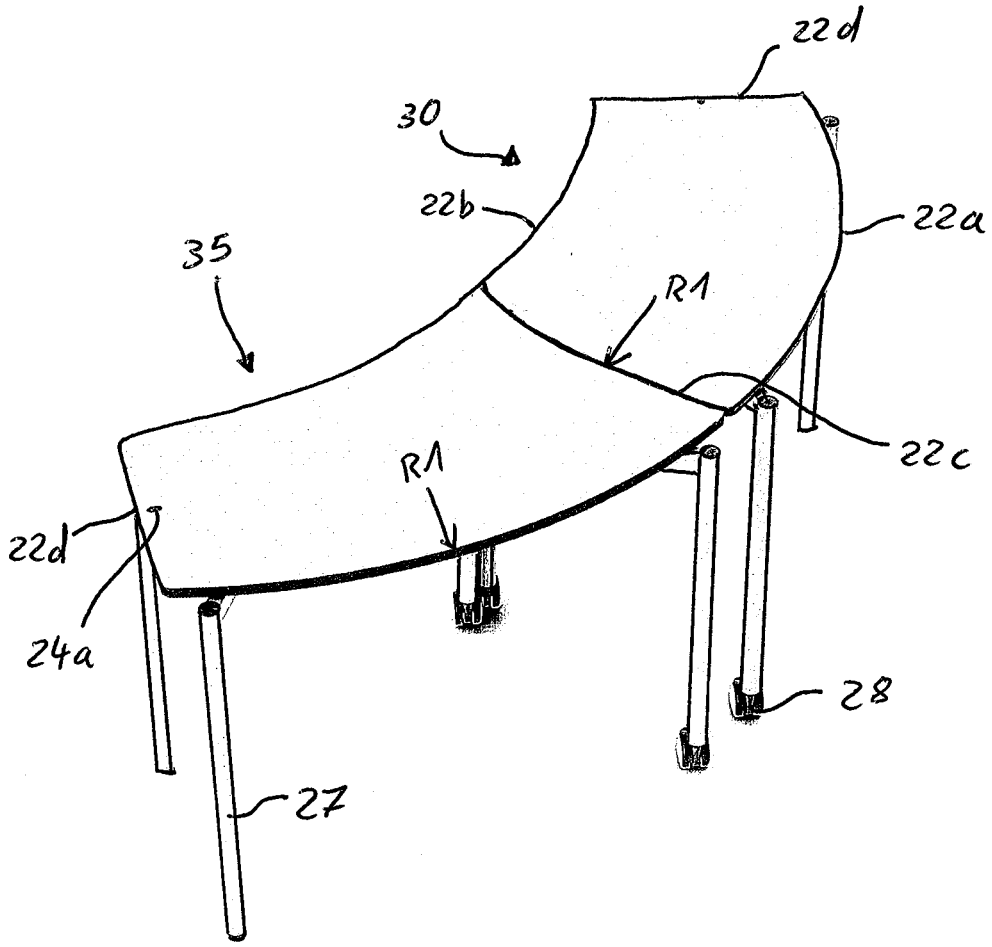
FIG. 6 is a schematic diagram of an exemplary arrangement of a variant of one first and one second item table furniture of the invention.

FIG. 6 shows a variation of the first and second items of table furniture 30, 35. In this variation, the other edges 22*d* of the second pair of edges of the table top 20 being shorter each have a substantially linear shape. As shown, even these first items of table furniture 30 and second items of table furniture 35 can advantageously be put together in a substantially gap-free manner.

An assembly kit for creating an array of items of furniture preferably includes the first items of table furniture 10 and the second items of table furniture 15 or their variations 30, 35. Alternatively, the assembly kit may comprise only first or second items of table furniture.

As exemplarily illustrated in FIGS. 12A through D, the first and second items of table furniture 10, 15 can be arranged or put together in various arched, annular, block or wave-like configurations.

Figure 4A:
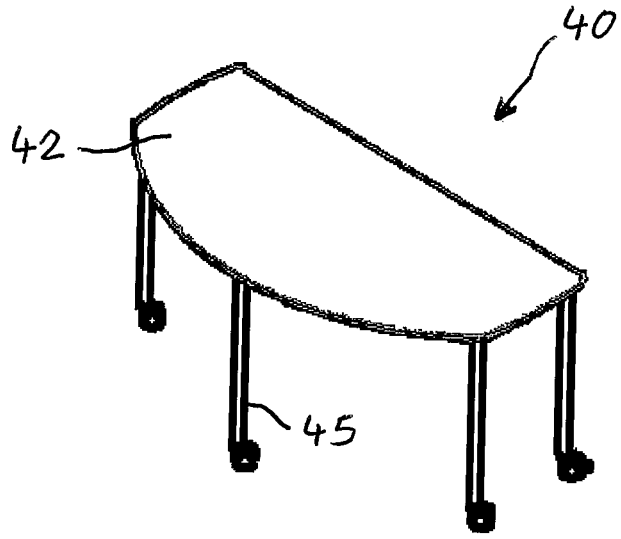
FIG. 4A is a perspective view of a third item of table furniture according to an embodiment of the invention.
Figure 5A:
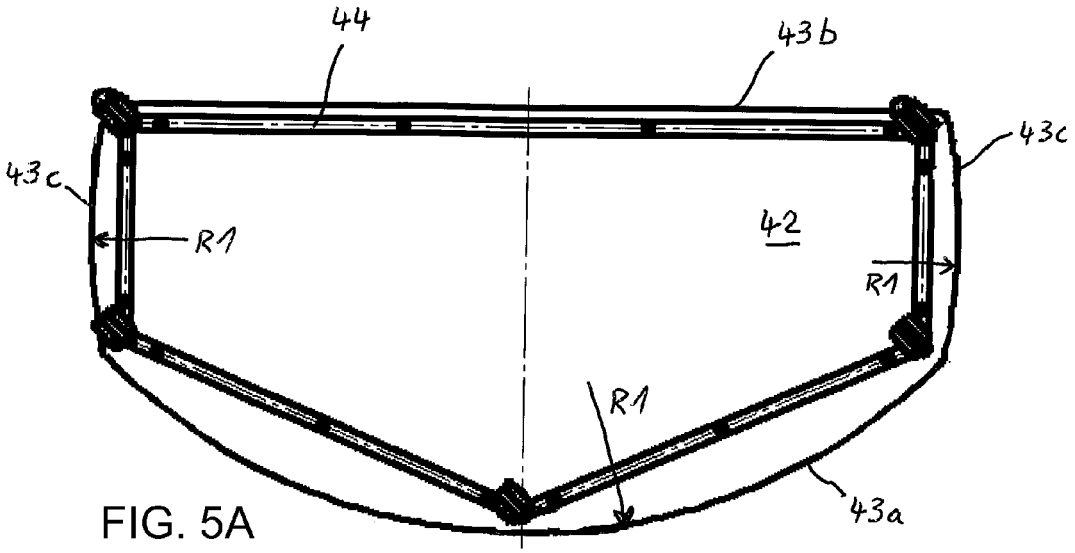
FIG. 5A is a bottom view of the third item of table furniture of FIG. 4A or 4B according to an embodiment of the invention.
Figure 5B:
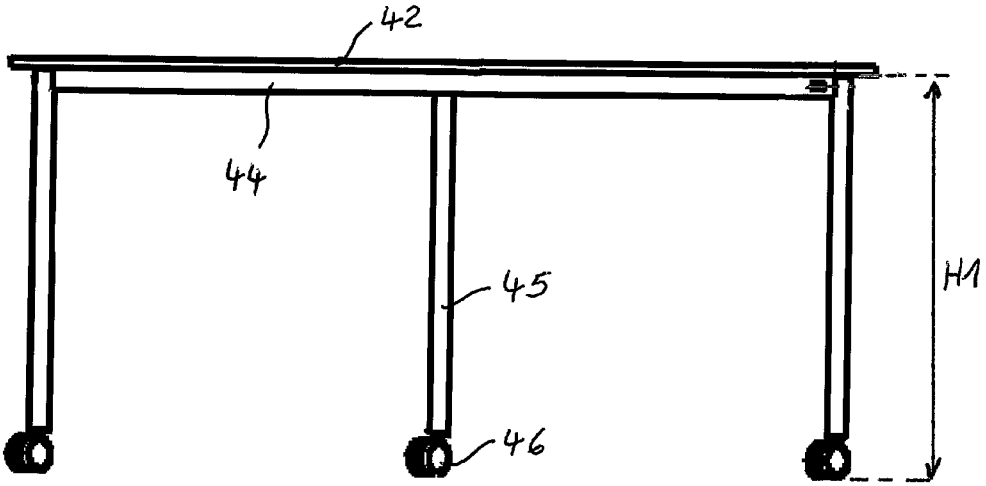
FIG. 5B is a side view of the third item of table furniture of FIG. 4A or 4B according to an embodiment of the invention.

Furthermore, the assembly kit may also include a third item of table furniture 40, which is shown in FIGS. 4A, 5A, 5B, and may be used for example as a main table, staff table or the like in an assembled configuration of tables.

The third item of table furniture 40 comprises a table top 42 (for example made of wood and/or plastic). In plan view, this table top 42 comprises a first pair of opposite long edges 43*a*, 43*b* (bottom, top in FIG. 5A), and a second pair of opposite short edges 43*c*, 43*d* (left, right in FIG. 5A) each connecting the first pair of edges 43*a*, 43*b* to one another. As shown in FIG. 5A, the one edge 43*a* of the first pair of edges has a convex curvature having the predetermined first radius of curvature R1 (the same first radius of curvature R1 as in the first and second items of table furniture), and the other edge 43*b* of the first pair of edges is designed linearly.

The two edges 43*c*, 43*d* of the second pair of edges of the table top 42 each have a convex curvature having the same first radius of curvature R1. Alternatively, concavely curved or linear configurations of the edges 43*c*, 43*d* of the second pair of edges are possible.

The table top 42 of this third item of table furniture 40 is significantly larger in size than the table top 20 of the first or second items of table furniture 10, 15. Preferably, the length of the convexly curved one edge 43*a* of the table 42 is at least twice as large as the length of the longer one edge 22*c* of the table top 20 of the first or second items of table furniture 10, 15, at least, however, at least twice as large as the length of the shorter other edge 22*d* of the table top 20 of the first or second items of table furniture 10, 15.

In a preferred embodiment of the third item of table furniture 40, the first radius of curvature R1 is about 110 cm, the length of the edges 43*a*, 43*b* of the first pair of edges is about 160 cm, and the length of the edges 43*c*, 43*d* of the second pair of edges is about 46 cm, without the invention being restricted to these dimensions.

As shown in FIGS. 5A and B, also the third item of table furniture 40 further comprises a table frame for supporting the table top 42. This table frame, in particular, comprises a frame 44 on which the table top 42 is resting and mounted, and (here five) table legs 45. The table legs 45 are each equipped with a caster 46. In this case, in plan view onto the item of table furniture 40, all table legs 45 preferably are located within or beneath the table top 42.

The table frames of the first items of table furniture 10, the second items of table furniture 15 and the third items of table furniture 40 preferably have substantially the same height H1.

As exemplarily illustrated in FIGS. 12E through J, also these third items of table furniture 40, together with the first items of table furniture 10 and the second items of table furniture 15, can be advantageously arranged or put together in various arc-shaped, round or block-like configurations.

Figure 4B:
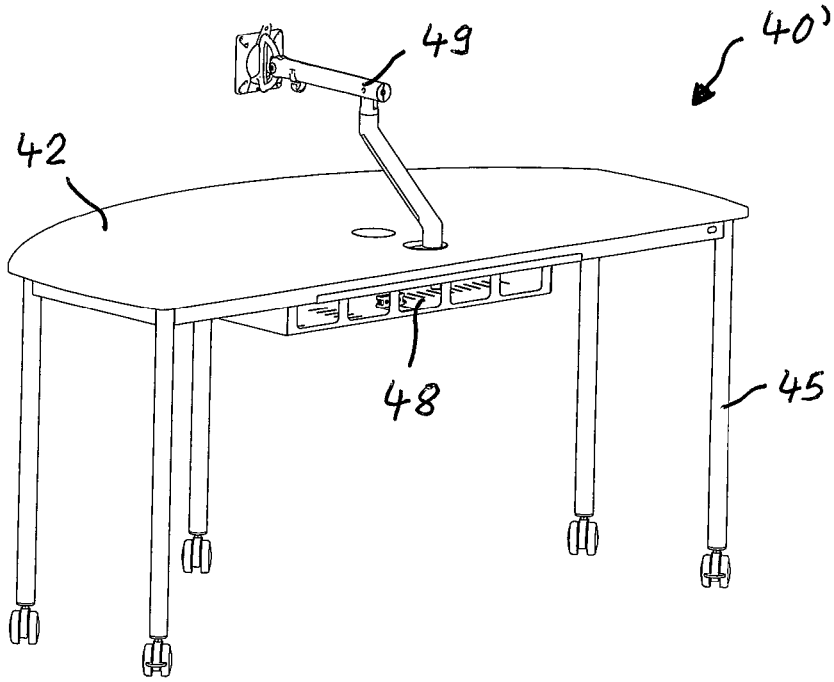
FIG. 4B is a perspective view of a variation of the third item of table furniture according to an embodiment of the invention.

In a variant of the third item of table furniture 40', which is shown in FIG. 4B, the table top 42 comprises a cable duct 48 or a console having various electrical connections at its underside, and a monitor holder 49 at its upper side.

Of course, numerous other arrays of tables made of the first, second and/or third items of table furniture 10, 15, 40 are possible, which are not shown in FIGS. 12A through J, optionally also together with further equal or different items of furniture.

Figure 7A:
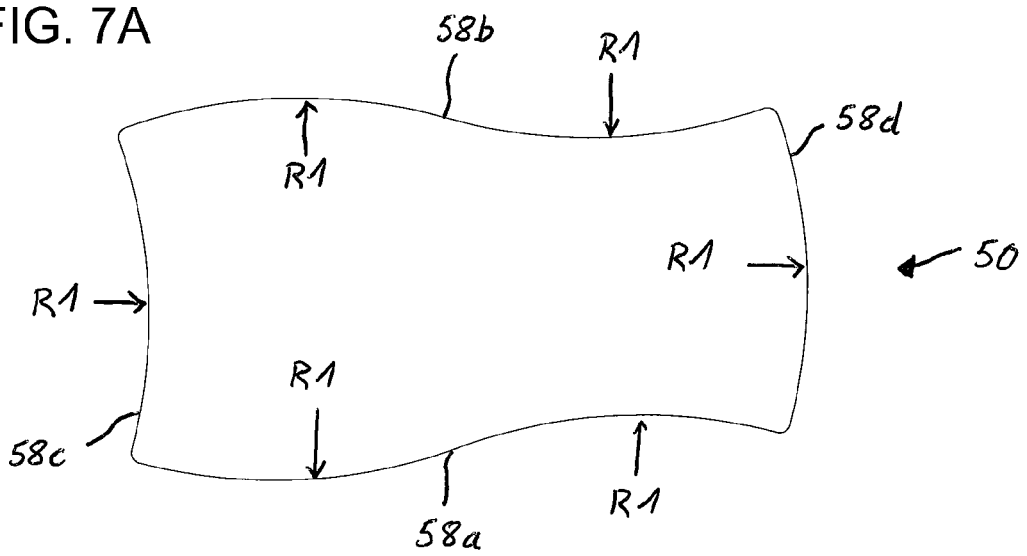
FIG. 7A is a plan view of a fourth item of table furniture according to an embodiment of the invention.
Figure 7B:
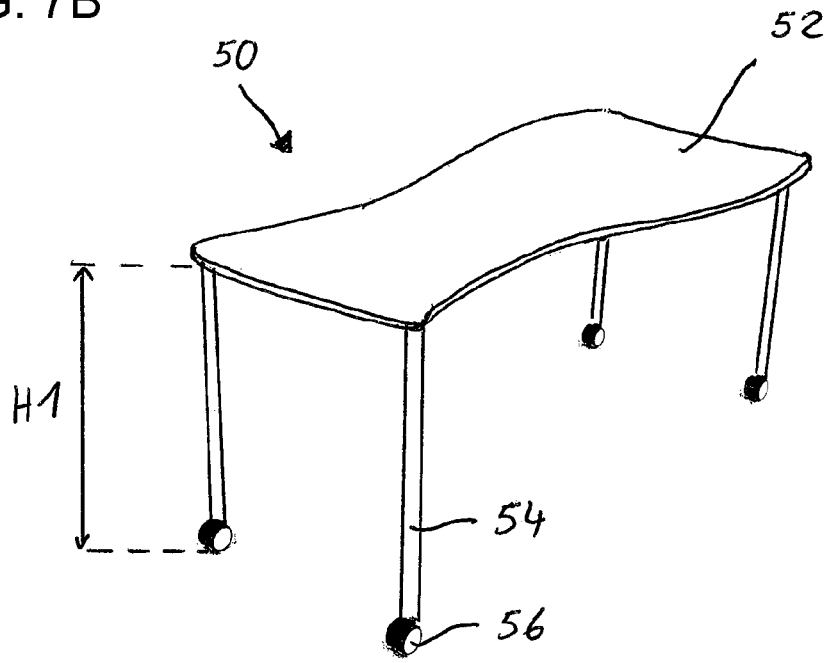
FIG. 7B is a perspective view of a fourth item of table furniture according to an embodiment of the invention.

The assembly kit may further comprise a fourth item of table furniture 50 which is shown in FIGS. 7A and B.

The fourth item of table furniture 50 comprises a table top 52 which, in plan view (see FIG. 7A), ha a first pair of opposite long edges 58*a*, 58*b* and a second pair of opposite short edges 58*c*, 58*d* each connecting the first pair of edges 58*a*, 58*b* to one another. The edges 58*a*, 58*b* of the first pair of edges each have one convexity having the first radius of curvature R1 and one concavity having the first radius of curvature R1, wherein these convexities are positioned facing each other and these concavities are positioned facing each other. The table top 52 of the fourth item of table furniture 50 is sized larger than the table tops 20 of the first and second items of table furniture 10, 15 and has a special "double wave form".

The second pair of edges 58*c*, 58*d* of the table top 52 preferably has a concave curved edge 58*c* and a convex curved edge 58*d* as shown in FIG. 7A, or alternatively, two linear edges 58*c*, 58*d*.

The lengths of the edges 58*a*, 58*b* of the first pair of edges are substantially the same size, and also the lengths of the edges 58*c*, 58*d* of the second pair of edges are substantially the same size. In this case, the length of the edges 58*a*, 58*b* of the first pair of edges is for example substantially twice as large as the length of the edges 58*c*, 58*d* of the second pair of edges. In addition, the length of the edges 58*c*, 58*d* of the second pair of shorter edges is for example approximately the equal size as the length of the one edge 22*c* or the length of the other edge 22*d* of the table top 20 of the first/second item of table furniture 10, 15.

The table frame of the fourth item of table furniture 50 comprises (in this case four) table legs 54 in the corner regions of the table top 52, which are preferably each equipped with a caster 56 to allow for simple and convenient moving the fourth item of table furniture 50. In this case, in plan view onto the item of table furniture 50, all table legs 45 are located within or below the table top 52, or for the purpose of space-saving stacking in part outside the table top 52. Optionally, the table frame also comprises a frame on which the table top 52 is mounted, or the table legs 54 are secured directly to the table top 52.

Although not illustrated, this fourth item of table furniture 50 can also be arranged or put together with the first items of table furniture 10, the second items of table furniture 15 and/or the third items of table furniture 40 to create a variety of configurations.

Figure 8A:
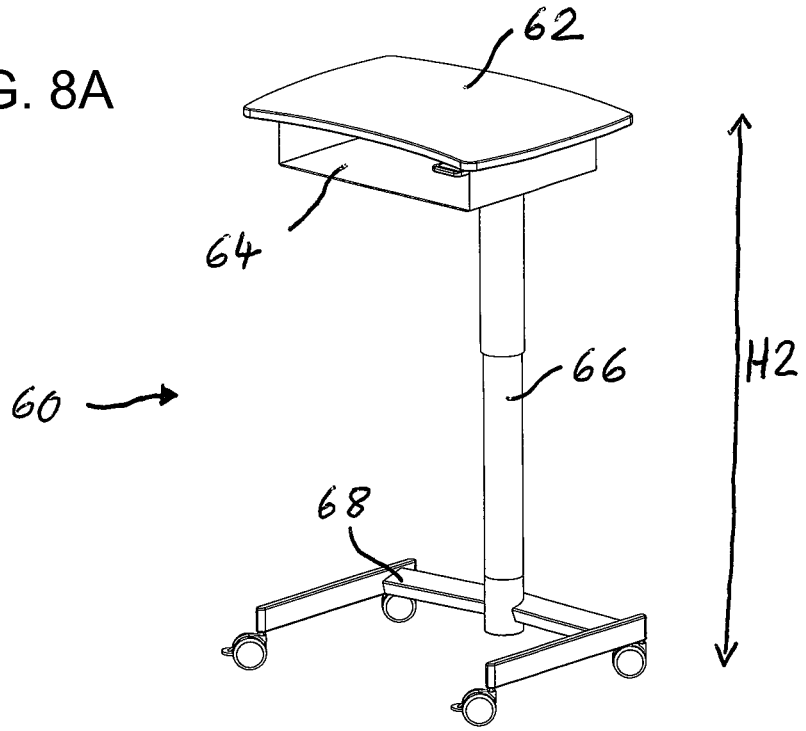
FIG. 8A is a perspective view of a fifth item of table furniture according to an embodiment of the invention.

FIGS. 8A and B show a fifth item of table furniture 60, which may also be part of the assembly kit.

Figure 8B:
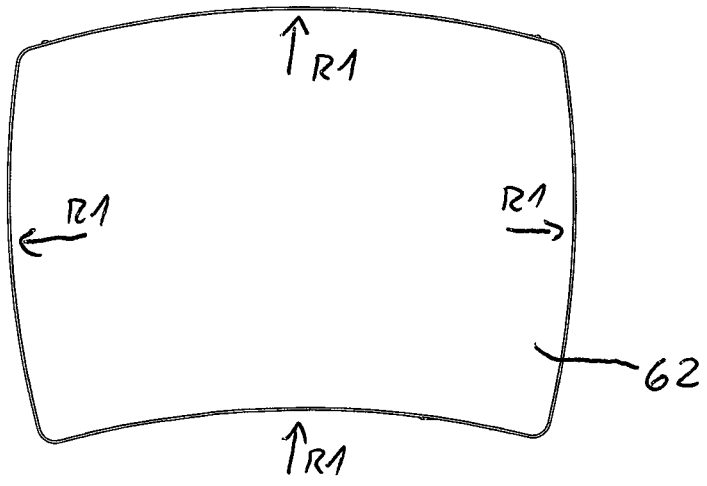
FIG. 8B is a plan view of the fifth item of table furniture of FIG. 8A.

The fifth item of table furniture 60 comprises a table top 62 which, in plan view (see FIG. 8B), comprises a first pair of opposite edges and a second pair of opposite edges each connecting the first pair of edges. The one edge of the first pair of edges (top in FIG. 8B) has a convex curvature having the first radius of curvature R1, and the other edge of the first pair of edges (bottom in FIG. 8B) has a concave curvature having the first radius of curvature R1. The edges of the first pair of edges have substantially the same length.

The edges of the second pair of edges each have a convexity having the first radius of curvature R1 and have substantially the same length. The edges of the second pair of edges may have a shorter length, or substantially the same length as the edges of the first pair of edges.

The table frame of the fifth item of table furniture 60 comprises a console 64 for supporting the table top 62 and storing objects, a height-adjustable table column 64 and a base 68 with casters, as illustrated in FIG. 8A. By means of the height-adjustable table column 66, the table frame of the fifth item of table furniture 60 can reach a second height H2 which is larger than the first height H1 of the table frames of the first, second, third and fourth items of table furniture.

Figure 12A:
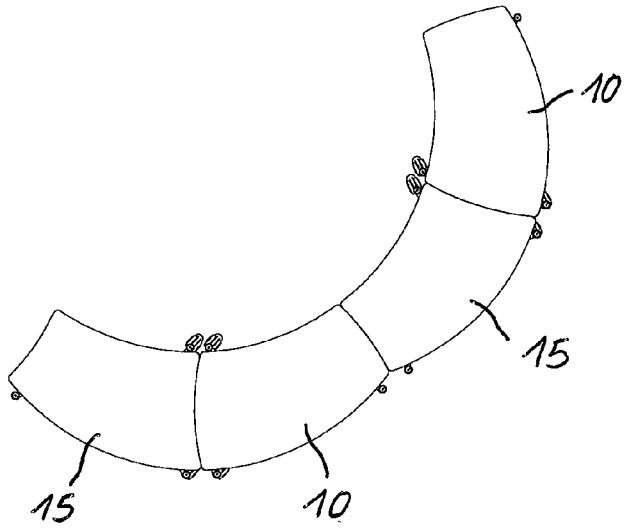
FIGS. 12A to 12R is schematic diagrams of various exemplary arrangements of items of furniture according to the invention.
Figure 12B:
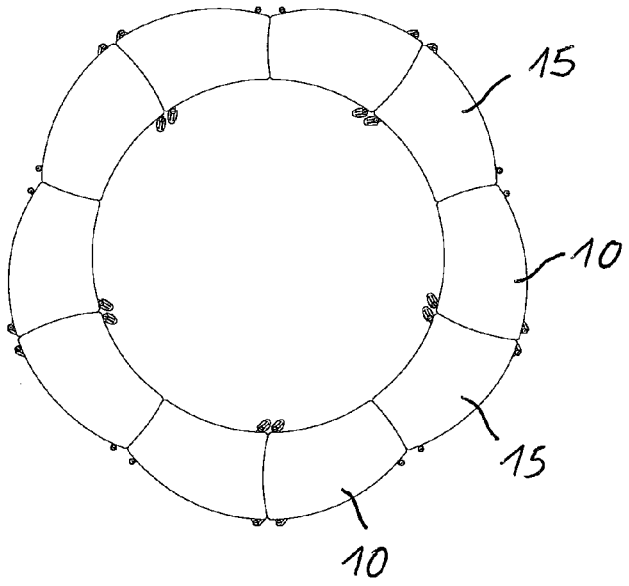
Figure 12C:
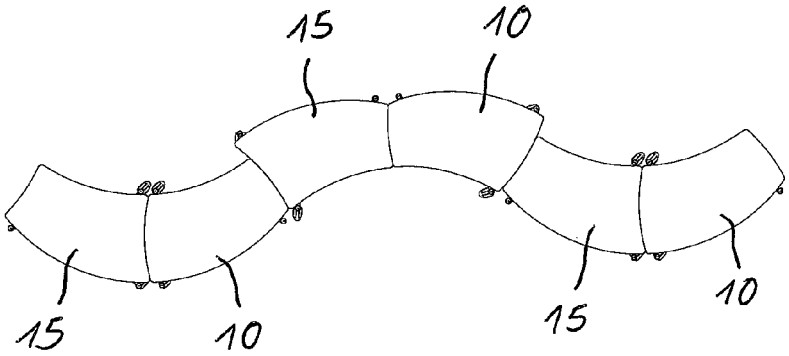
Figure 12D:
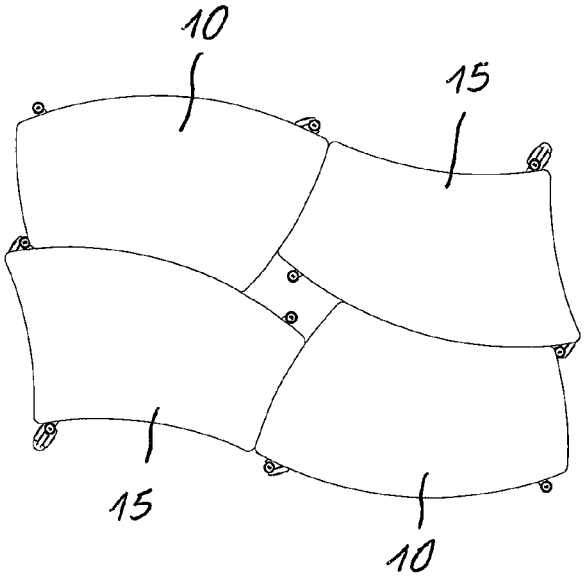
Figure 12E:
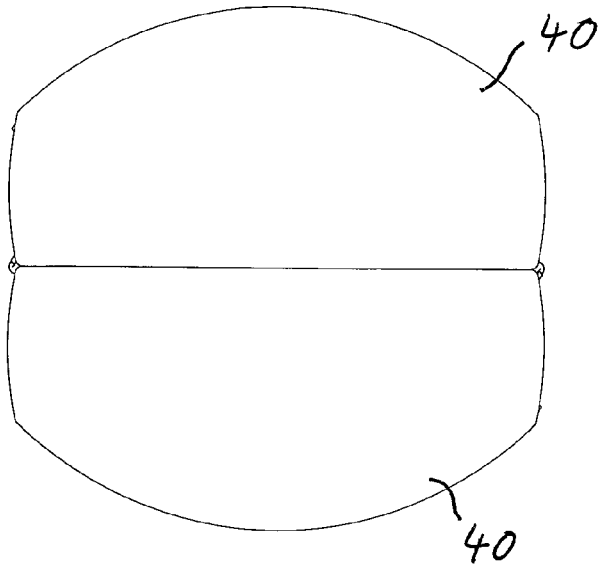
Figure 12F:
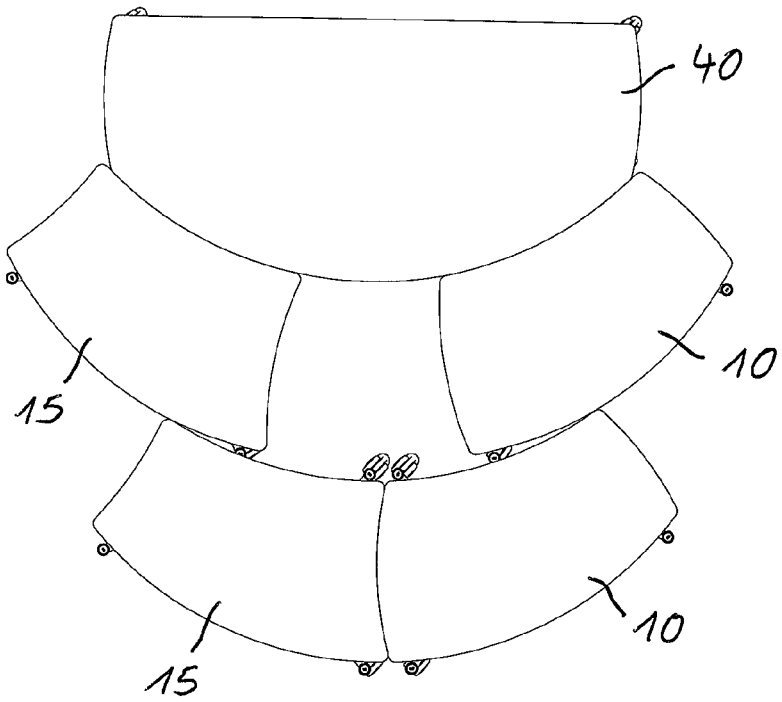
Figure 12G:
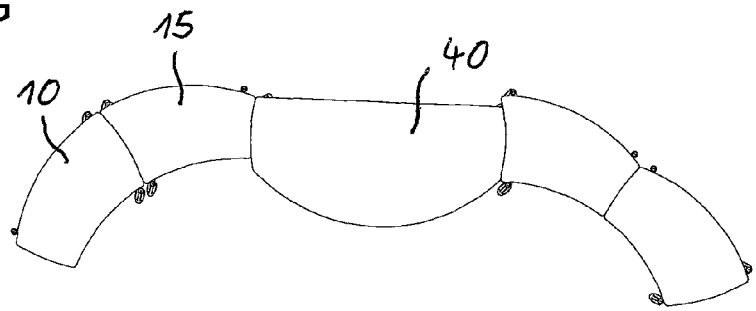
Figure 12H:
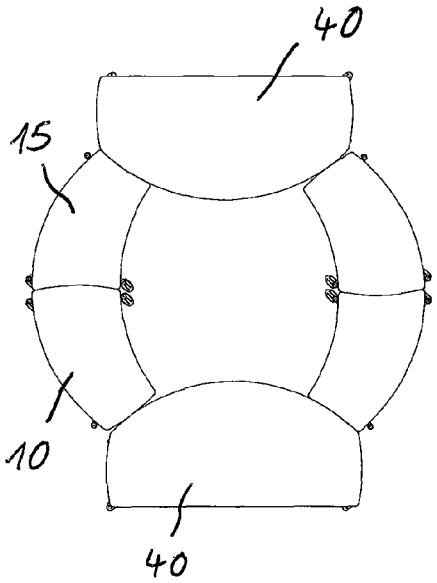
Figure 12I:
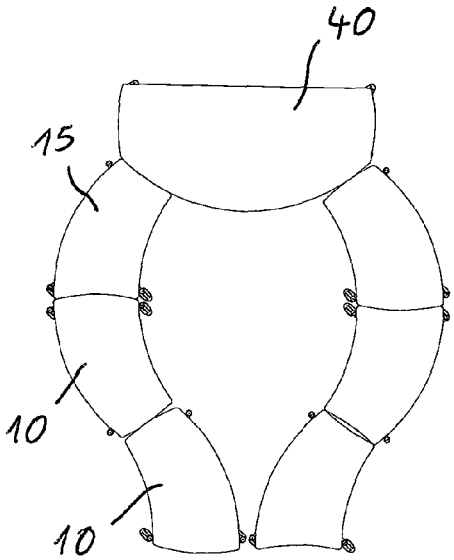
Figure 12J:
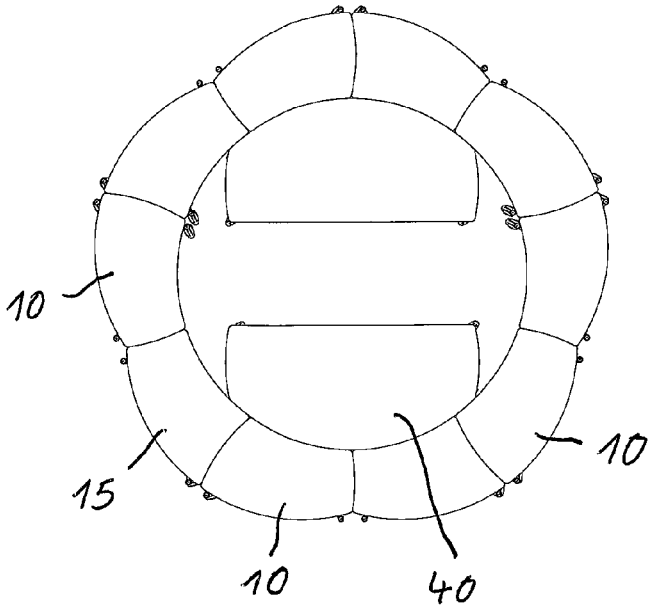
Figure 12K:
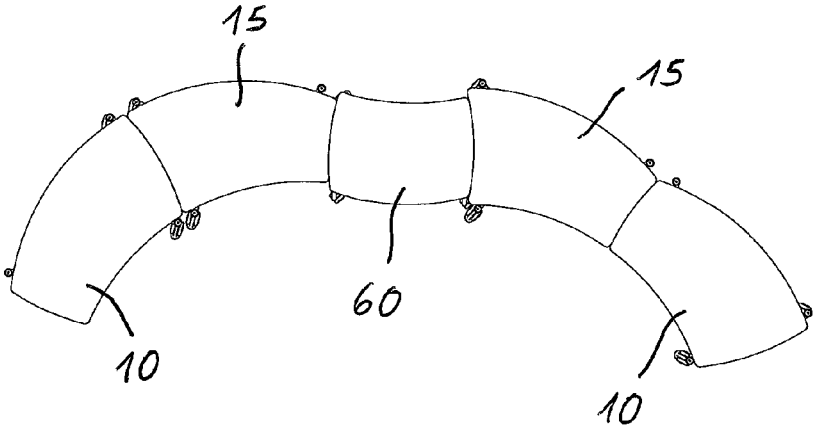

As exemplarily illustrated in FIG. 12K, this fifth item of table furniture can also be arranged or put together with the other items of table furniture (e.g. 10, 15 in FIG. 12K) of the assembly kit 60 to create various table configurations.

In addition to the various items of table furniture described above, the assembly kit may also include items of shelf furniture. FIGS. 9A through C show an item of shelf furniture 70 comprising an arcuate body 72, which can also be arranged or put together with the above described items of table furniture 10, 15, 40, 50 to create different configurations or workplace arrangements.

As can be seen in particular in FIG. 9B, the body 72 of the item of shelf furniture 70 has, in plan view, a first pair of opposite sides 73*a*, 73*b* and a second pair of opposite sides 73*c*, 73*d* each connecting the first pair of sides to one another.

The one side 73*a* of the first pair of sides has a concave curvature having the first radius of curvature R1 and is, for example, substantially closed (for example, side wall, perforated plate, etc.). The opposite other side 73*b* of the first pair of sides has a convex curvature having a second radius of curvature R2, which is larger than the first radius of curvature R1, and is designed substantially open serving as a user side.

The central axes of the two curvatures of the sides 73*a*, 73*b* of the first pair of sides of the body 72 lie on a common center axis. Thus, the sides 73*c*, 73*d* of the second pair of sides of the body 72 have substantially the same length. In the embodiment of FIGS. 9A through C, the sides 73*c*, 73*d* of the second pair of sides have a linear shape.

Due to the consistent first radius of curvature at the curved edges of the items of table furniture and the curved back side 73*a* of the item of shelf furniture 70, they can be variably arranged or put together to create different workplace arrangements. The item of shelf furniture 70 preferably has a third height H3, which is larger than the first height H1 of the various items of table furniture so that the item of shelf furniture 70 for example can also serve as a partition wall or a room divider.

The body 72 of the item of shelf furniture 70 is equipped with a plurality of casters 76 at its bottom so that the item of shelf furniture 70 can be easily moved.

Figure 12L:
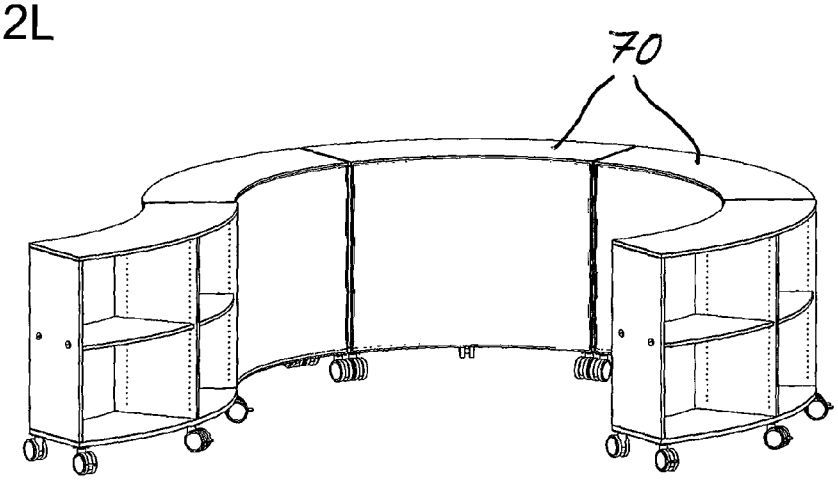

As shown in FIGS. 9A through C, at the sides 73*c*, 73*d* of the second pair of sides there are provided magnetic coupling elements 74*a*, 74*b*. In the preferred embodiment, one first coupling element 74*a* and one second coupling element 74*b* having opposite magnetic polarities or being a magnet element and a steel element are arranged at predetermined positions on the sides 73*c*, 73*d*. Thus, two items of shelf furniture 70 can be moved abutting each other and be detachably connected to each other by means of the magnetic coupling elements 74*a*, 74*b* in order to obtain a stable shelf configuration, as exemplarily shown in FIG. 12L. The magnetic coupling elements 74*a*, 74*b* are each positioned at the same height position for all items of shelf furniture 70, even if the items of shelf furniture have different heights H3.

Further, two handle 75 are attached at the top side of the body 72 in the vicinity of the sides 73*c*, 73*d* of the second pair of sides. The handles 75 extend, for example, substantially parallel to the sides 73*c*, 73*d* of the second pair of sides. Using these handles 75, the item of shelf furniture 70 can be gripped and moved more easily.

As shown in FIG. 10, in addition, the assembly kit may comprise further items of shelf furniture 80 which have a substantially parallelepiped-shaped (in plan view, substantially rectangular) body having linear sides of the first and second pair of sides. In other respects, this further item of shelf furniture 80 corresponds to the item of shelf furniture 70 of FIGS. 9A through C.

Figure 12M:
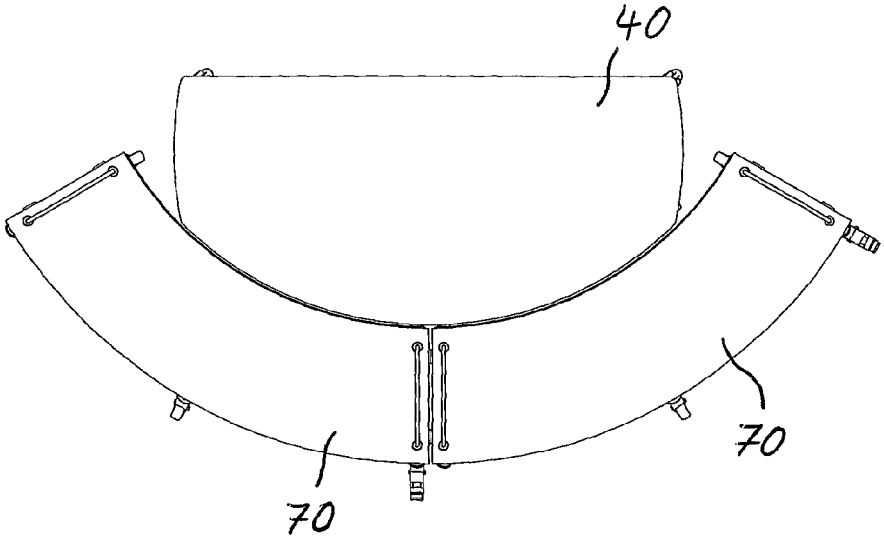
Figure 12N:
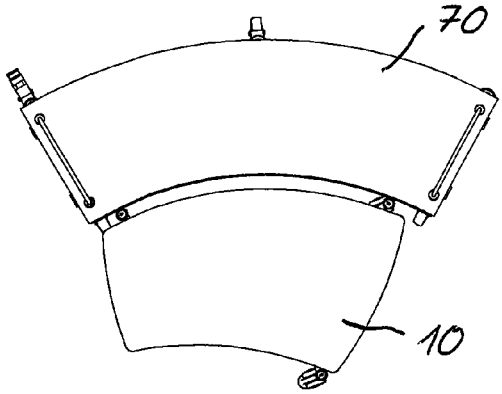
Figure 12O:
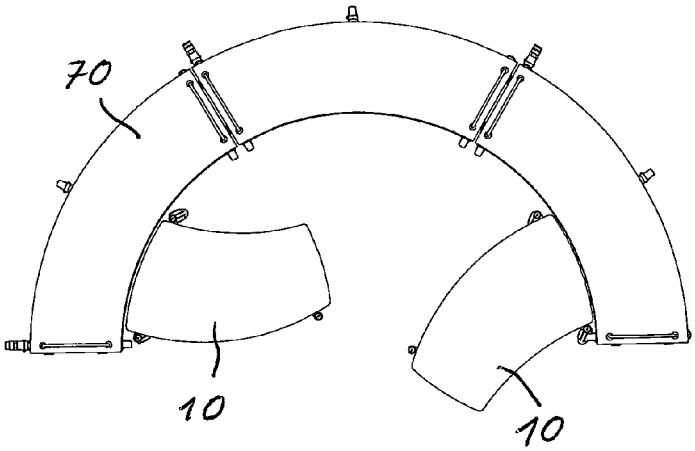

As exemplarily illustrated in FIGS. 12M through O, even this item of shelf furniture can be arranged or put together with the items of table furniture described above (in this case, for example 40 or 10) of the assembly kit to create different workplace arrangements.

Finally, the assembly kit may also include seating furniture. FIGS. 11A and B show an upholstered item of seating furniture 90 comprising an arc-shaped body 92, which can also be arranged or put together with the items of table furniture and/or the items of shelf furniture to create different configurations.

The item of seating furniture 90 comprises a body 92 which, in plan view, has a first pair of opposite sides 93*a*, 93*b* and a second pair of opposite sides 93*c*, 93*d* each connecting the first pair of sides to one another. The one side 93*a* of the first pair of sides has a convex curvature having the first radius of curvature R1, and the other side 93*b* of the first pair of sides has a concave curvature having a third radius of curvature R3 which is smaller than the first radius of curvature R1.

The central axes of the two curvatures of the sides 93*a*, 93*b* of the first pair of sides of the body 92 lie on a common center axis. Thus, the sides 93*c*, 93*d* of the second pair of sides of the body 92 have substantially the same length. In the embodiment of FIGS. 11A and B, the sides 93*c*, 93*d* of the second pair of sides have a substantially linear shape.

The body 92 of the item of seating furniture 90 is equipped with a plurality of furniture gliders 98 at its bottom so that a floor can be protected when moving the item of seating furniture 90.

As illustrated in FIG. 11B, the item of seating furniture 90 itself may assembled from a kit in two-part form. The kit of the item of seating furniture 90 comprises for example a box-shaped base 94 and a box-shaped cushion 95 which can be connected to each other via a hook and loop connection 96. When providing the base 94 and/or the cushion 95 in different heights, items of seating furniture 90 can be variably assembled in many different overall heights.

Similarly to the items of shelf furniture, the assembly kit can also include further items of seating furniture 91 which have a substantially parallelepiped-shaped (in plan view, essentially rectangular) body having linear sides of the first and the second pair of sides. In other respects, this further item of seating furniture corresponds to the item of seating furniture 90 of FIGS. 11A and B.

Figure 12P:
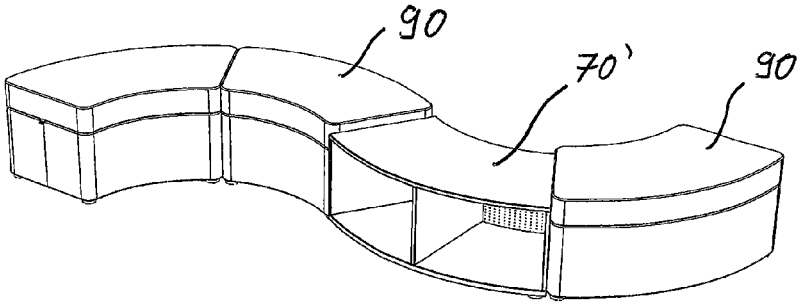
Figure 12Q:
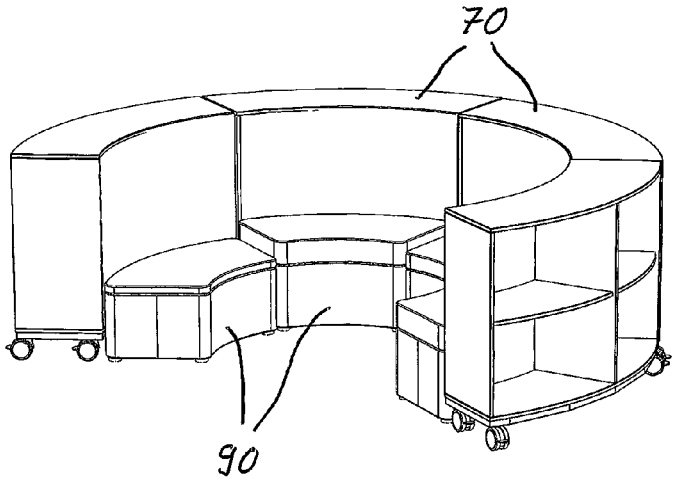
Figure 12R:
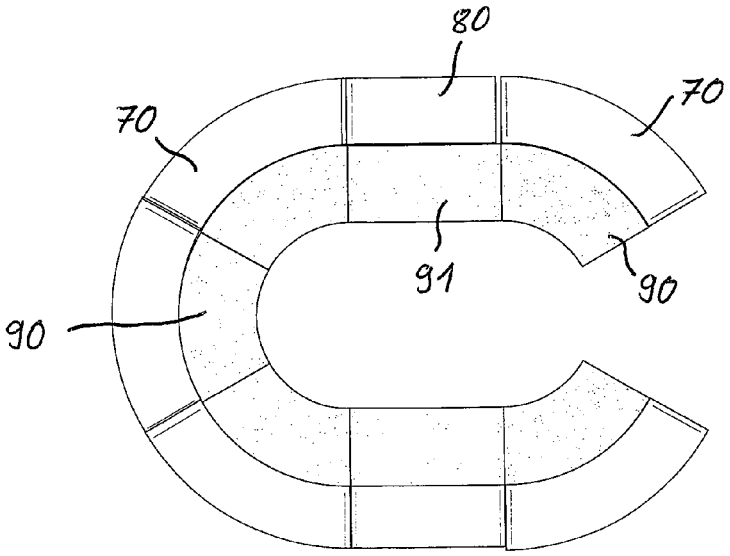

Due to the consistent first radius of curvature R1 at the curved edges of the items of table furniture, the curved back sides 73*a* of the items of shelf furniture 70 and the curved sides 93*a* of the items of seating furniture 90, they can be arranged or put together variably to create different workplace arrangements. As illustrated in FIGS. 12P through R, these items of seating furniture 90 may arranged or put together in particular in a ring or wave design and, if necessary, together with the items of shelf furniture 70. In the example of FIG. 12P, the array includes a plurality of items of seating furniture 90 as well as a variation of the item of shelf furniture 70' having a reduced height; in the example of FIG. 12Q, the array includes a plurality of items of seating furniture 90 arranged annularly, around which there is arranged a plurality of items of shelf furniture 70; and FIG. 12R shows a variant of the array of FIG. 12Q including further items of seating furniture 91 and further items of shelf furniture 80 each comprising a cuboid body.

The following is a summary list of reference numerals and the corresponding structure used in the above description of the invention:

10 first item of table furniture
15 second item of table furniture
20 table top
22*a* the one edge of the first pair of edges (convex)
22*b* the other edge of the first pair of edges (concave)
22*c* the one edge of the second pair of edges (longer)
22*d* the other edge of the second pair of edges (shorter)
24*a* first auxiliary device for gripping
24*b* second auxiliary device for gripping
26 frame

27 table leg
28 caster
30 first item of table furniture (variation)
35 second item of table furniture (variation)
40 third item of table furniture (first variant)
40' third item of table furniture (second variant)
42 table top
43*a* the one edge of the first pair of edges
43*b* the other edge of the first pair of edges
43*c* the one edge of the second pair of edges
43*d* the other edge of the second pair of edges
44 frame
45 table leg
46 caster
48 cable duct
49 monitor holder
50 fourth item of table furniture
52 table top
54 table leg
56 caster
58*a* the one edge of the first pair of edges
58*b* the other edge of the first pair of edges
58*c* the one edge of the second pair of edges
58*d* the other edge of the second pair of edges
60 fifth item of table furniture
62 table top
64 console
66 height-adjustable table column
68 base with casters
70 item of shelf furniture
70' item of shelf furniture (reduced height)
72 body
73*a* the one side of the first pair of sides
73*b* the other side of the first pair of sides
73*c* the one side of the second pair of sides
73*d* the other side of the second pair of sides
74*a* first magnetic coupling member
74*b* second magnetic coupling member
75 handle
76 caster
80 another item of shelf furniture
90 item of seating furniture
91 another item of seating furniture
92 body
93*a* the one side of the first pair of sides
93*b* the other side of the first pair of sides
93*c* the one side of the second pair of sides
93*d* the other side of the second pair of sides
94 base
95 cushion
96 hook and loop connection
98 furniture glider
H1 first height (of 10, 15, 40, 50)
H2 second height (of 60)
H3 third height (of 70, 80)
R1 first radius of curvature
R2 second radius (larger than R1)
R3 third radius (smaller than R1)
W opening angle

The invention claimed is:

1. An assembly kit for generating an array of items of furniture, comprising:

at least one first item of table furniture, having a table top and a table frame supporting said table top, wherein said table top of said first item of table furniture, in plan view, having a first pair of mutually opposite edges and a second pair of mutually opposite edges each connecting said first pair of edges to one another;

said first pair of edges of said first item of table furniture including a convex edge with a convex curvature and a concave edge with a concave curvature;

said convex curvature of said convex edge and said concave curvature of said concave edge of said first pair of edges of said first item of table furniture each having a pre-determined first radius of curvature of substantially equal size;

said second pair of edges of said first item of table furniture including a longer edge and a shorter edge, said longer edge of said second pair of edges having a greater length than said shorter edge of said second pair of edges; and at least one second item of table furniture, having a table top and a table frame supporting said table top, and being configured different from said at least one first item of table furniture;

said table top of said second item of table furniture, in plan view, having a first pair of mutually opposite edges and a second pair of mutually opposite edges each connecting said first pair of edges to one another;

said first pair of edges of said second item of table furniture including a convex edge with a convex curvature and a concave edge with a concave curvature;

said convex curvature of said convex edge and said concave curvature of said concave edge of said first pair of edges of said second item of table furniture each having said pre-determined first radius of curvature;

said second pair of edges of said second item of table furniture including a longer edge and a shorter edge, said longer edge of said second pair of edges having a greater length than said shorter edge of said second pair of edges; and said second pair of edges of said table top of said first item of table furniture including a convex edge with a convex curvature, and said second pair of edges of said table top of said second item of table furniture including a concave edge with a concave curvature.

2. The assembly kit according to claim 1, wherein one or more of the following applies:

the lengths of said convex edges of said first pairs of edges of said table tops of said first item of table furniture and of said second item of table furniture each have a substantially equal value; or the lengths of said concave edges of said first pairs of edges of said table tops of said first item of table furniture and said second item of table furniture each have a substantially equal value; or the lengths of said longer edges of said second pairs of edges of said table tops of said first item of table furniture and said second item of table furniture each have a substantially equal value; or the lengths of said shorter edges of said second pairs of edges of said table tops of said first item of table furniture and said second item of table furniture each have a substantially equal value.

3. The assembly kit according to claim 1, comprising:

at least one third item of table furniture having a table top and a table frame supporting said table top, wherein said table top, in plan view, comprises a first pair of mutually opposite edges and a second pair of mutually opposite edges each connecting said first pair of edges to one another;

wherein one edge of said first pair of edges of said table top of said third item of table furniture has a convex curvature with said first radius of curvature; and wherein a length of said one edge of said first pair of edges of said table top of said third item of table furniture is at least as long as twice a length of the shorter edge of said second pair of edges of said table top of said first item of table furniture or said second item of table furniture.

4. The assembly kit according to claim 3, wherein said table top of said third item of table furniture comprises at least one further feature selected from the following group:

the other edge of said first pair of edges of said table top of said third item of table furniture having a substantially linear shape;

the one edge of said second pair of edges of said table top of said third item of table furniture having a convex curvature with said first radius of curvature, a concave curvature with said first radius of curvature, or a substantially linear shape; and the other edge of said second pair of edges having a convex curvature with said first radius of curvature, a concave curvature with said first radius of curvature, or a substantially linear shape.

5. The assembly kit according to claim 1, comprising at least one fourth item of table furniture comprising a table top and a table frame supporting said table top, wherein said table top, in plan view, comprises a first pair of mutually opposite edges and a second pair of mutually opposite edges each connecting said first pair of edges to one another;

wherein each of said edges of said first pair of edges of said table top of said fourth item of table furniture has a convexity with said first radius of curvature and a concavity with said first radius of curvature; and wherein said convexities are positioned across from one another and said concavities are positioned across from one another.

6. The assembly kit according to claim 5, wherein said table top of said fourth item of table furniture comprises at least one further feature selected from the following:

a length of the edges of said first pair of edges being substantially twice as large as a length of the edges of said second pair of edges;

the one edge of said second pair of edges having a convex curvature with said first radius of curvature, a concave curvature with said first radius of curvature or a substantially linear shape;

the other edge of said second pair of edges having a convex curvature with said first radius of curvature, a concave curvature with said first radius of curvature or a substantially linear shape; and a length of the edges of said second pair of edges being substantially equal to a length of said longer edge or said shorter edge of said second pair of edges of said table top of said first or second item of table furniture.

7. The assembly kit according to claim 1, comprising at least one item of shelf furniture including a body which, in plan view, has a first pair of mutually opposite sides and a second pair of mutually opposite sides each connecting said first pair of sides to one another, wherein one side of said first pair of sides has a concave curvature with said first radius of curvature.

8. The assembly kit according to claim 7, wherein said body of said item of shelf furniture comprises at least one further feature selected from the group consisting of:

one side of said first pair of sides having a substantially closed design;

the other side of said first pair of sides having a convex curvature with a second radius of curvature that is larger than said first radius of curvature;

the sides of said second pair of sides having a substantially linear shape; and which comprises at least one magnetic coupling device disposed on the sides of said second pair of sides.

9. The assembly kit according to claim 7, further comprising at least one further item of shelf furniture having a body with a substantially rectangular shape, in plan view.

10. The assembly kit according to claim 1, comprising at least one item of seating furniture including a body which, in plan view, has a first pair of mutually opposite sides and a second pair of mutually opposite sides each connecting said first pair of sides to one another, wherein one side of said first pair of sides has a convex curvature with said first radius of curvature.

11. The assembly kit according to claim 10, wherein said body of said item of seating furniture comprises at least one further feature selected from the group consisting of:

the side of said first pair of sides opposite the one side having a concave curvature with a third radius of curvature which is smaller than said first radius of curvature;

the sides of said second pair of sides having a substantially linear shape;

said body being configured as an upholstered item of seating furniture; and said body being formed as an assembly kit made of at least two components.

12. The assembly kit according to claim 10, further comprising at least one further item of seating furniture having a body with a substantially rectangular shape, in plan view.

13. The assembly kit according to claim 1, comprising:

at least one fifth item of table furniture having a table top and a table frame supporting said table top;

said table top, in plan view, including a first pair of mutually opposite edges and a second pair of mutually opposite edges each connecting said first pair of edges to one another;

at least one edge of said first pair of edges having a convex curvature with said first radius of curvature; and said table frame including a height-adjustable table column.

14. The assembly kit according to claim 1, wherein said convex curvature of said convex edge of said second pair of edges of said table top of said first item of table furniture and said concave curvature of said concave edge of said second pair of edges of said table top of said second item of table furniture each have a radius of curvature of substantially equal size.

15. The assembly kit according to claim 1, wherein said convex curvature of said convex edge of said second pair of edges of said table top of said first item of table furniture and said concave curvature of said concave edge of said second pair of edges of said table top of said second item of table furniture each have said first radius of curvature.

16. The assembly kit according to claim 1, wherein said shorter edge of said second pair of edges of said table tops of said first and second items of table furniture is formed with at least one of a convex curvature with said first radius of curvature, a concave curvature with said first radius of curvature, and a substantially straight shape.

17. The assembly kit according to claim 1, wherein said table tops of said first and second items of table furniture, in plan view, are each spanning an arcuate segment having an opening angle selected from the group consisting of 30°, 36°, 45°, 60°, 72° and 90°.

18. The assembly kit according to claim 1, wherein said table frames of said first and second items of table furniture each comprise a plurality of table legs, and said plurality of table legs include at least one table leg disposed outside a footprint of said table top, in plan view.

19. The assembly kit according to claim 1, wherein said table frames of said first and second items of table furniture each comprise a plurality of table legs, the table legs of said plurality of table legs located in a region of one edge or the other edge of one of said pairs of edges each being provided with a caster, and said table tops of said first and second items of table furniture, in a region of the respectively other edge or the one edge of said one pair of edges, each include at least one auxiliary device for gripping said table top.

* * * * *